United States Patent [19]

Hogeland

[11] Patent Number: 5,003,738

[45] Date of Patent: Apr. 2, 1991

[54] ARTICLE AND METHOD OF IMPROVING EXTERIOR BUILDING APPEARANCE

[76] Inventor: Robert Hogeland, R.D. #2, Zimmerman Rd., Newmanstown, Pa. 17073

[21] Appl. No.: 539,492

[22] Filed: Jun. 18, 1990

[51] Int. Cl.[5] ..... E06B 3/26; B44F 7/00

[52] U.S. Cl. ..... 52/202; 52/311

[58] Field of Search ..... 52/202, 203, 311, 314, 52/476, 477

[56] References Cited

U.S. PATENT DOCUMENTS

| | | | |
|---|---|---|---|
| 1,813,162 | 7/1931 | Hoegger | 52/202 |
| 2,686,988 | 8/1954 | Garber | 47/35 |
| 3,227,061 | 1/1966 | Swayze | 98/1 |
| 3,447,274 | 6/1969 | Davidson | 52/173 |
| 4,021,980 | 5/1977 | Wilfong | 52/202 |
| 4,454,691 | 6/1984 | Mitchell | 52/202 |

FOREIGN PATENT DOCUMENTS

| | | | |
|---|---|---|---|
| 2304758 | 10/1976 | France | 52/203 |

OTHER PUBLICATIONS

The Condensed Chemical Dictionary, by Arthur and Elizabeth Rose; Reinhold Publishing Corporation, New York, 5th Edition, 1956.

*Primary Examiner*—Richard E. Chilcot, Jr.
*Assistant Examiner*—Robert J. Canfield
*Attorney, Agent, or Firm*—Michael F. Petock

[57] ABSTRACT

A structure and method of improving the exterior appearance of a building is provided wherein a frame and panels simulating windows are installed on the exterior of the building. The frame is installable on new or existing construction.

16 Claims, 2 Drawing Sheets

FIG. 1
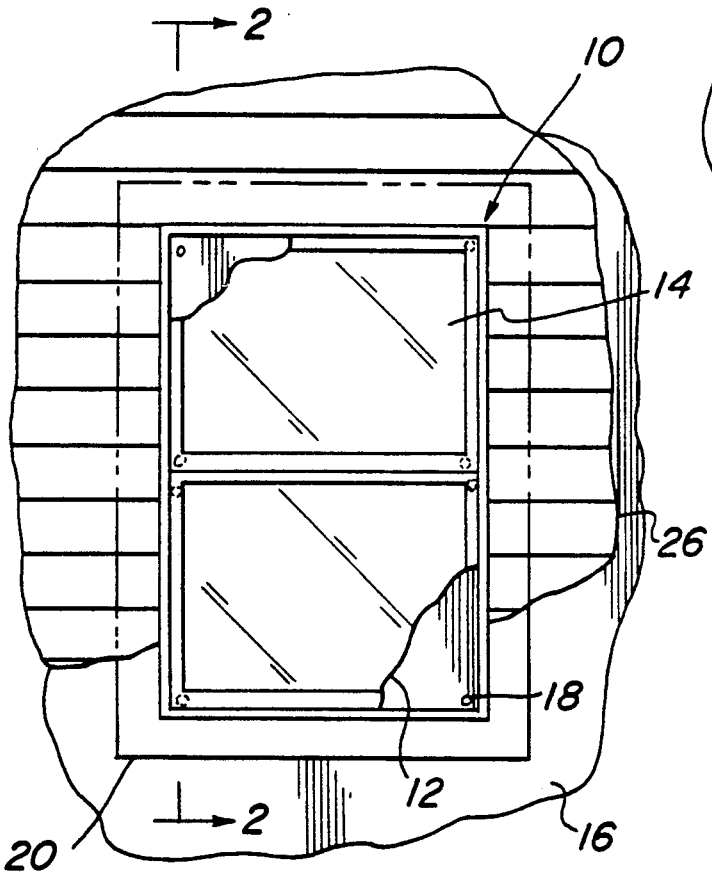
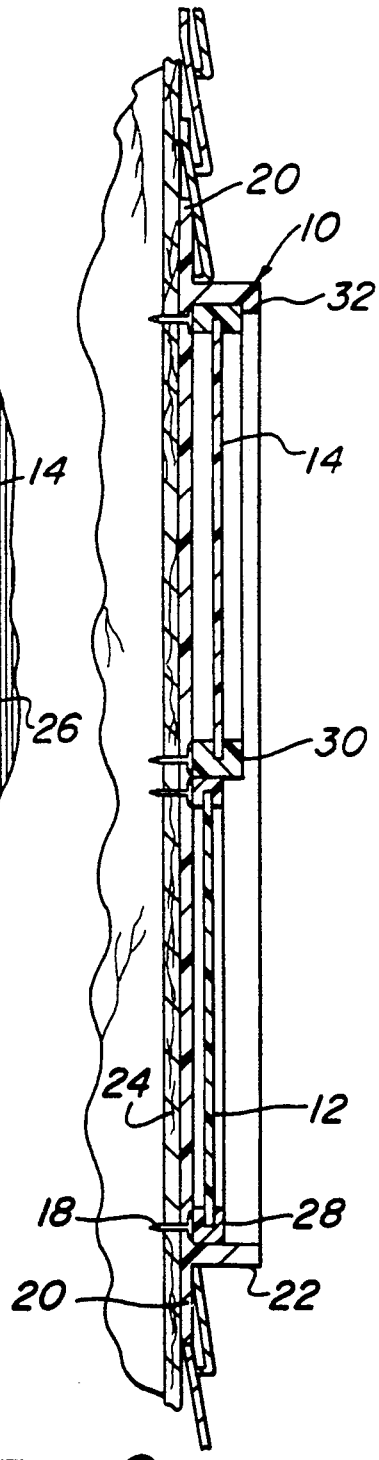
FIG. 2

ARTICLE AND METHOD OF IMPROVING EXTERIOR BUILDING APPEARANCE

BACKGROUND OF THE INVENTION

The present invention relates to an article of manufacture and a method of improving the exterior appearance of a building, and particulary of residential buildings. Further, the present invention relates to the appearance of windows on the exterior of a building.

The cost of housing is continuing to rise and at least some would-be homeowners are being forced out of the purchase of a home because of the rising cost. By some estimates, significant numbers of people are unable to afford housing.

There has been an effort to produce more reasonably priced housing. This effort has been directed at both the average residential building and those deemed to be housing of somewhat lower cost.

One of the significant cost factors in the building of a residence is windows. The cost of windows is important in the cost of the windows themselves and also in the special framing needed to "frame out" for a window. Additionally, labor costs are increased both on the interior and the exterior as the drywall or other interior covering needs to be cut out around it and molding needs to be applied around the interior of the window, and on the exterior of the building, the siding needs to be cut and fitted around the window. Accordingly, it is not uncommon to see residential structures which appear to have what is sometimes referred to as a "boxy" appearance, particularly due to the absence of a sufficient number of windows. There may also be a lack of symmetry of exterior appearance due to the absence of a window where, from the exterior view, it would seem appropriate that a window would be there. The present invention provides a solution to these problems both for existing construction and new construction.

SUMMARY OF THE INVENTION

The present invention provides an improved exterior building appearance by enabling the providing of the appearance of a window either in new construction or existing construction at significantly less than the cost of the installation of a real window.

The present invention reduces the cost as compared to the cost of a real window to provide an improved exterior appearance thereby providing the appearance of a window in walls without windows or without sufficient windows, or to make the outside appearance more symmetrical with respect to the distribution of windows.

A further advantage of the present invention is the providing of the appearance of windows without the cost of framing the opening in the exterior wall or otherwise forming an opening such as where the structure may be made of brick, masonry or other building material.

The present invention provides savings with respect to the labor and materials otherwise required to trim or install molding around the inside of the window. It further saves the cost of having interior wall finishing around the window.

The present invention provides the appearance of an exterior window without the heat loss associated with real windows and/or without the cost associated with expensive energy saving windows.

Another advantage of the present invention is that it provides the homeowner or designer with greater interior design options, while still maintaining the exterior appearance as desired, since the designer does not have to work around windows.

Another advantage of the present invention is that it may be installed not only on new construction, but also on existing homes, particularly those with vinyl siding or the like.

Briefly, in accordance with the present invention, an article of manufacture is provided which may be readily installed in new construction or existing construction. The article of manufacture comprises a frame for supporting one or more panels, to simulate real window sashes and the like. The frame is attachable to the exterior wall of the building in any conventional manner including the use of screws, nails and the like. The frame is preferably provided with a flange on its perimeter which is adapted and constructed so that the siding of the building will overlap the flange to butt the siding against the window in a manner similar to real window installation. The flange is optional.

At least one panel is adapted to be installed in the frame. The number of panels will depend upon the type of window being simulated. In some cases, it could be a single panel. In other cases, in the case of double hung windows, it is contemplated in a preferred embodiment that there would be two panels, one representing the lower sash and the other representing an upper sash. Each panel is provided with a structure which simulates the exterior of a window sash and the frame is provided with the structure of the outer appearance of a window frame.

The present invention further contemplates the method of providing an improved appearance of the exterior of a building in the form of additional windows comprising the steps of attaching a frame for supporting one or more panels to the exterior of the wall of a building at the location where the siding normally attaches and installing one or more panels in the frame. As discussed above, the frame may or may not include the flange, and an additional step would be the providing of siding to mate with the window and overlap the flange or to merely abut the flange and caulk the same.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is an elevation view of an article of manufacture in accordance with the present invention installed on a building with the siding partially broken away.

FIG. 2 is a cross-sectional view taken along line 2—2 of FIG. 1.

DETAILED DESCRIPTION OF THE PREFERRED EMBODIMENTS

Figure 4:
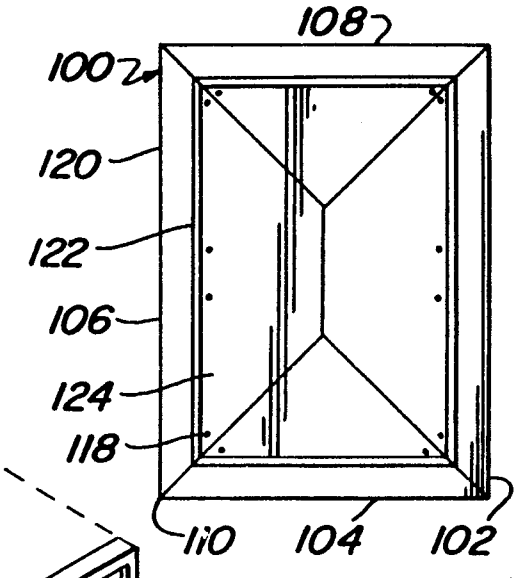
FIG. 4 is a plan view of a frame in accordance with the embodiment shown in FIG. 3.

Referring now to the drawings in detail, wherein like numerals indicate like elements, there is shown in FIG. 1 a frame 10 having panels 12 and 14 mounted therein. Frame 10 is mounted to the exterior of an exterior wall 16 of a building by means of fasteners 18. Fasteners 18 may be any suitable type of fastener, such as screws or nails. Alternatively, the frame may be attached by adhesive, although in a presently preferred embodiment it is anticipated that fasteners such as nails or screws may be more convenient.

Frame 10 may be provided with a flange 20 around its periphery. Flange 20 would provide suitable flashing for the siding which is normally attached on the exterior of the exterior wall of a building. As may be seen in FIGS. 1 and 2, siding will be installed to overlap the flange in new construction. Where the installation is to improve the exterior appearance of an existing building, the flanging would be installed by sliding or inserting it under the existing siding. In other words, frame 10 is comprised of a projecting portion 22 and a flange 20 which continues as a backer 24. The backer is utilized for nailing and to create the necessary uniform appearance of a window, as it may be desirable to have behind the transparent or semi-transparent panels 12 and 14.

Frame 10 may be constructed of any suitable semi-rigid or rigid material. Preferably, the material would have a significant degree of corrosion resistance. In a presently preferred embodiment, frame 10 would be molded utilizing polyvinyl chloride (vinyl) or other suitable synthetic material which has a certain degree of flexibility. In this manner, frame 10 may be installed in new construction and in existing buildings. In new construction, frame 10 would merely be nailed, screwed or adhesively bonded to the exterior of the exterior wall. In installations involving existing construction, the siding would be cut to the outer dimensions of projecting member 22 of frame 10 and the frame could be bent sufficiently to slide the flange portion 20 of the frame 10 underneath the siding 26.

However, for installations involving existing construction, and paricularly where it may be desirable to construct a frame of more rigid material, such as the more rigid synthetics and/or aluminum, the embodiment described hereinafter with respect to FIGS. 3 and 4 would be more desirable.

As discussed above, frame 10 would be attached to the exterior of the exterior building wall 16 by suitable fasteners, which may be in the form of screws, nails or adhesive. Any suitable number of screws or nails may be utilized from two to an unlimited number. However, in a presently preferred embodiment as illustrated in FIG. 1, it is contemplated that eight screws or nails 18 would be appropriate.

Panels 12 and 14 may be constructed of any suitable type glazing material including the thermoplastic poly-(methyl methacrylate)-type polymers which are commercially available under the trademark "PLEXIGLAS" from Rohm & Haas Company of Philadelphia and other suppliers. Alternatively, other synthetic glazing materials or glass may be utilized for the panels 12 and 14. In a presently preferred embodiment, it is preferred that the panels 12 and 14 be constructed of PLEXIGLAS to substantially reduce the possibility of breakage both in handling and after installation. Further, since the structure described herein would not be utilized as an actual window, there is no need to utilize glass. However, glass or any other suitable type of glazing material may be utilized. The glazing material which comprises panels 12 and 14 would preferably be provided with a light tint which would more realistically create the impression of a window even from close inspection, as it would be difficult to see through the tinted panels and to observe the nails behind them or other structure.

Panels 12 and 14 are mounted within structure which simulates that of a window sash. For example, panel 12 is mounted within a sash like structure 28 and panel 14 is mounted in a sash like structure 30. The sash like structure or frame 28 is constructed of a narrower width than sash or frame structure 30 so that the appearance of a real window is provided by having the lower panel 12 with its sash structure 28 indented from upper panel 14 with its sash structure 30. In other words, the upper sash structure 30 with its panel 14, projects more toward the exterior of the building than does panel 12 with its sash structure 28, which therefore provides the appearance of a normal window. Sash structures 28 and 30 may be comprised of any suitable material, including polyvinyl chloride, other synthetics, aluminum or the like. In the present preferred embodiment, the sash structures would be comprised of the same material as frame 10, and preferably would be vinyl. The sash structures 28 and 30 may be retained in frame 10 by any suitable means, including clips or an inward projection on projection 22 of frame 10, or by adhesively mounting them in place. Outward projection 22 may be provided with a lip about its entire inner periphery as shown in 32. In such a case, the sash structures 28 and 30 would merely snap into frame 10. This is particularly a suitable procedure where the polyvinyl chloride frame 10 is somewhat flexible.

Figure 3:
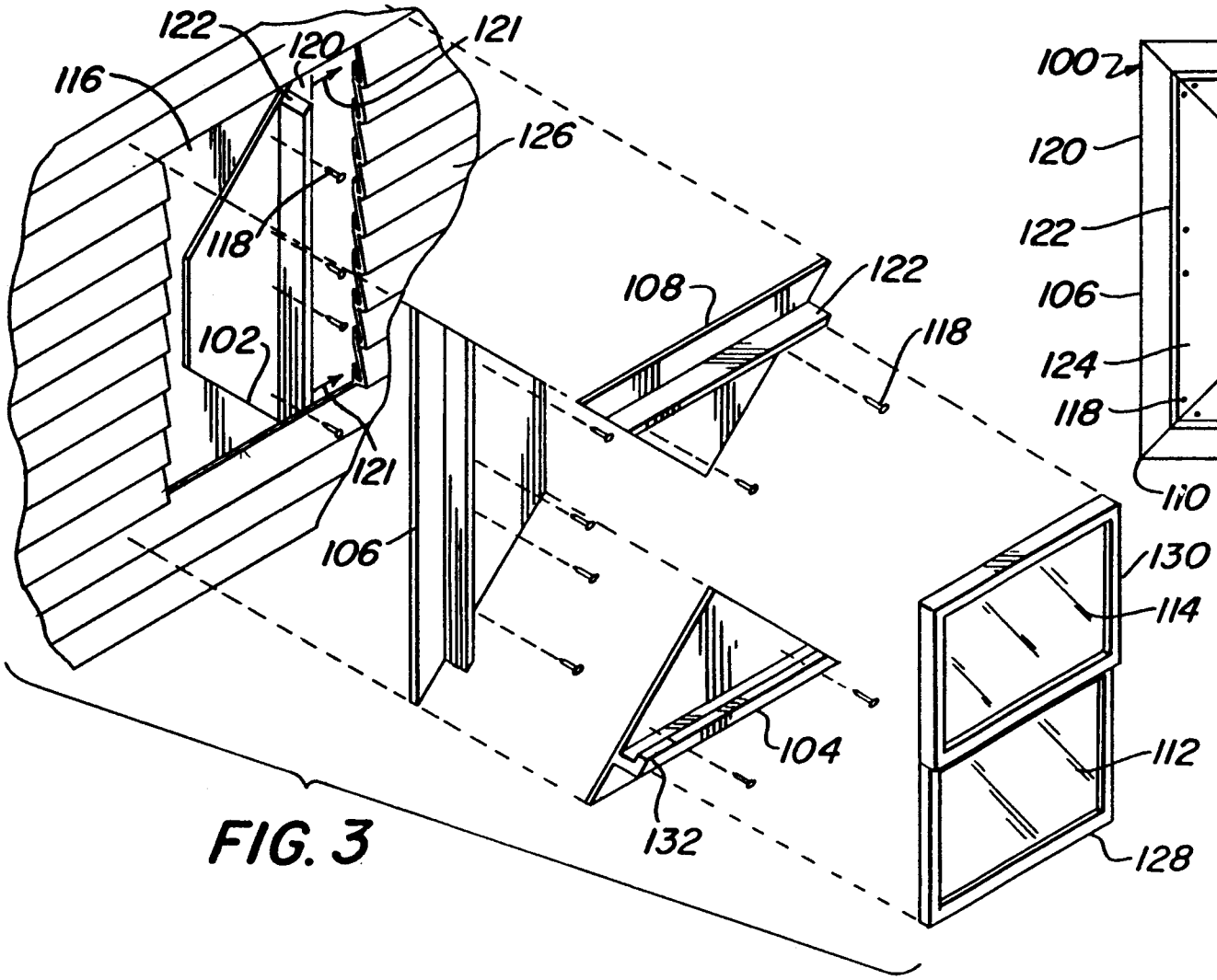
FIG. 3 is an exploded view in perspective of an alternate embodiment of the present invention in the process of installation in an existing building.

Referring now to FIGS. 3 and 4, there is shown an alternative embodiment of the present invention wherein the frame, denominated 100 herein to distinguish it from the frame described in FIGS. 1 and 2, is comprised of multiple parts. As shown in FIGS. 3 and 4, in a presently preferred embodiment, frame 100 is comprised of multiple parts 102, 104, 106 and 108 which are shown in FIG. 4. Pieced together and in exploded form in FIG. 3. As illustrated, a preferred form of the division of the frame 100 would pass through the corners of frame 100, such as shown at 110. However, it is understood that other forms of dividing the frame could be used, for example, the frame could be formed of corner pieces, that is the dividing lines would pass through the middle of the top and bottom and the sides or at any other location along the top, bottom and sides. However, in view of the fact that conventional windows often have their joints to the corners, it is presently preferred that the division be along these lines. Further, in reference to the term division, this term is utilized merely for the purposes of description and it is anticipated that the units would be molded as the pieces which make up the entire frame, and not the entire frame made and then cut, although either approach may be utilized within the scope of the present invention.

The structure of frame 100 is substantially similar to that described with respect to frame 10 except for frame 100 being constructed of multiple component parts. Frame 100 may be provided with a flange 120 and a projecting portion 122. Additionally, as with respect to frame 10, a backing member 124 is provided for each component piece. Each component piece may be fastened to the exterior of the exterior wall of the building by suitable fasteners, such as nails 118, screws or other suitable fasteners or by means of adhesive.

As described above, flanges 20 and 120 are not essential in that the frame may be attached to the exterior wall of the building and the siding brought to it and the joint appropriately caulked. However, in a preferred embodiment of the present invention, frames 10 and 100 would be provided with the flanging which would provide a built in form of flanging.

Frame 100 may be utilized on new or existing construction, but the ease of installation in existing construction is illustrated in FIG. 3. As shown in FIG. 3, the siding 126 may be cut out to the outer dimension of projection members 122 of frame 100. Of course, in this cutting, the cutting may be done within normal tolerances, and an extra one-quarter of an inch may be allowed for ease of installation. However, once the cutting is completed, the individual component pieces may be installed in the opening by inserting them, perhaps cocked at first and then inserted into the siding opening with flange 120 being slid in the direction of arrow 121 to slide it behind the siding 126. The component 102 would then be nailed by means of nails 118, or other suitable fasteners, to the exterior of the exterior building wall 116. In a similar manner, as illustrated in FIG. 3, the parts or components 106, 108 and 104 of frame 100 would be inserted and nailed.

Panels 112 and 114 with their sashes 128 and 130 would be installed in a manner similar to that as described with respect to FIGS. 1 and 2. Again, the sashes, as illustrated in FIG. 3, are of different widths so that the appearance of a normal upper and lower sash is created. The upper and lower panels may be retained in frame 100 in any of the various manners as described with respect to FIGS. 1 and 2. The possible use of a lip on projection member 122 is illustrated on component 104 at 132. However, as described above, this lip is not essential, as the panels may be held in place by use of adhesive, clips, intermittent projections of the type of lip 132, but not continuous, or any other suitable means. Other suitable means include fasteners through the sash structures 128 and 130, although this is not particularly desirable since these may be viewed from the exterior. However, such fasteners could be put into recessed holes with snap-on caps which cover the screw or nail heads, as is conventional and well known in the fabricating arts.

Particularly with respect to existing construction, the frame which is comprised of multiple parts, such as component parts 102, 104, 106 and 108 which make up frame 100 or other component shapes, such as the rectangular shapes described above, may be formed so that when they are put together to form the frame for the window on the side of the building, the component pieces overlap, thereby creating a more effective seal against various weather elements including rain and wind.

With respect to the use of the present invention, particularly in the application to existing construction, the flange of the frame may be provided with J channel before the flange is inserted behind the existing siding. J channel, as is well known in the siding field, is channel material which has the shape of a J in cross section, and is utilized for various applications, including the termination or joint where the siding butts to the window frame. In connection with the present invention, to enable ease of application of such J channel into position between the projecting portion of the frame 122 or 22, the J channel may be fastened by rivets, adhesive or other suitable fastening means to the flange before it is inserted or it may be formed as part of the flange. Such application of J channel would be particularly more adaptable to the embodiments of FIGS. 3 and 4 or other similar component window frames.

Although the present invention has been illustrated with respect to the simulation of a conventional double hung window, it is understood that various other types of windows may be simulated using the structure and concepts of the present invention. For example, in certain cases, only a single panel would be utilized to illustrate perhaps an unopenable picture window or a casement window. Alternatively, more than two panels may be utilized to simulate other types of windows. However, other modifications and variations of the present invention will be apparent to those skilled in the art within the scope and spirit of the teachings of the present invention presented herein.

In view of the above, the present invention may be embodied in other specific forms without departing from the spirit or essential attributes thereof and, accordingly, reference should be made to the appended claims, rather than to the foregoing specification as indicating the scope of the invention.

I claim:

1. An article of manufacture, comprising: a frame for supporting one or more panels, said frame being attachable to the exterior wall of a building, at least one panel adapted to be installed in said frame, said panel being provided with a structure which simulates the exterior of a window sash and said frame being provided with the outer appearance of a window frame.

2. An article of manufacture in accordance with claim 1 wherein said frame is provided with a flange on its perimeter adapted and constructed so that the siding of the building will overlap said flange.

3. An article of manufacture in accordance with claim 1 wherein said frame is comprised of multiple parts to enhance ease of installation on existing buildings.

4. An article of manufacture in accordance with claim 3 wherein said frame is divided into four parts, and the lines of division run to the corners of the frame.

5. An article of manufacture in accordance with claim 1 wherein said at least one panel comprises a first and a second panel, said first panel corresponding to the lower sash of a window and said second panel corresponding to the upper sash of a window.

6. A article of manufacture in accordance with claim 1 wherein said frame is comprised of vinyl.

7. An article of manufacture in accordance with claim 1 wherein said panel is comprised of substantially transparent thermoplastic poly-(methyl methacrylate)-type polymers.

8. An article of manufacture in accordance with claim 1 wherein said at least one panel is comprised of glass.

9. An article of manufacture in accordance with claim 3 wherein said frame is aluminum.

10. An article of manufacture in accordance with claim 1 wherein said frame is attached by fasteners in the form of nails.

11. An article of manufacture in accordance with claim 1 wherein said frame is attached by fasteners in the form of screws.

12. A method of providing an improved exterior appearance to a building in the form of an additional window, comprising the steps of :

attaching a frame for supporting one or more panels to an exterior surface of an exterior wall of a building at a location where the siding normally attaches; and installing one or more panels in said frame.

13. A method in accordance with claim 12 including the additional step of causing a flange on the periphery of said frame to be overlaid with the siding of the building.

14. A method in accordance with claim 12 wherein said step of attaching the frame to the building includes the step for attaching multiple pieces of the frame to the building exterior wall.

15. A method in accordance with claim 12 wherein said step of installing one or panels in said frame includes the steps of installing a first panel corresponding to the lower sash of a window and a second panel corresponding to the upper sash of a window.

16. An exterior wall of a building, comprising:

a wall having an exterior and interior surface;

a frame for supporting one or more glazing panels, said frame being attached to said wall such that it is visible on the exterior surface of said wall;

at least one glazing panel being installed in said frame, said panel being provided with structure on its periphery which simulates a window sash; and said frame being provided with structure which simulates the outer appearance of a window frame.

* * * * *

UNITED STATES PATENT AND TRADEMARK OFFICE

CERTIFICATE OF CORRECTION

PATENT NO. : 5,003,738

DATED : April 2, 1991

INVENTOR(S) : Robert Hogeland

It is certified that error appears in the above-identified patent and that said Letters Patent is hereby corrected as shown below:

Column 4, line 37, after"FIG. 4", delete ".".

Column 4, line 37, delete "Pieced" and substitute therefor

-- pieced --.

Signed and Sealed this

Fourth Day of August, 1992

*Attest:*

DOUGLAS B. COMER

*Attesting Officer*

*Acting Commissioner of Patents and Trademarks*